US005323959A

United States Patent [19]

Draper

[11] Patent Number: 5,323,959

[45] Date of Patent: Jun. 28, 1994

[54] COMBINATION MAILBOX INDICIA DISPLAY AND DEPOSITORY

[76] Inventor: William M. Draper, 107 Ripplewater La., Cary, N.C. 27511

[21] Appl. No.: 49,109

[22] Filed: Apr. 19, 1993

[51] Int. Cl.[5] ..... B65D 91/00

[52] U.S. Cl. ..... 232/33; 232/29; 232/46; 232/17

[58] Field of Search ..... 232/17, 27, 29, 33, 232/38, 39, 46; 40/312, 594, 611

[56] References Cited

U.S. PATENT DOCUMENTS

| | | | |
|---|---|---|---|
| 717,888 | 1/1903 | Miller | 232/33 |
| 808,872 | 1/1906 | Raymond | 232/33 |
| 2,534,163 | 12/1950 | Enghauser | 232/38 |
| 2,650,756 | 9/1953 | Rubesch | 232/33 |
| 4,148,432 | 4/1979 | Cornwell | 232/24 |
| 5,067,650 | 11/1991 | Jones | 232/17 |
| 5,207,378 | 5/1993 | Detchon | 232/17 |

*Primary Examiner*—Flemming Saether
*Attorney, Agent, or Firm*—John G. Mills and Associates

[57] ABSTRACT

This invention is a combination mailbox indicia display and depository that is adapted to be mounted on the top, curved dome portion of a mailbox. The depository has two inwardly and upwardly disposed sides that are made from a material having a memory so that the upper edges of such side portions can be spread apart to insert informational material and to hold the same securely in place. Indicia display is in the form of elongated panels and are preferably removably mounted on the depository so that seasonal symbols and other message indicia can be displayed as desired.

6 Claims, 2 Drawing Sheets

COMBINATION MAILBOX INDICIA DISPLAY AND DEPOSITORY

FIELD OF INVENTION

This invention relates to mailboxes and more particularly to mailbox indicia display means having an exterior depository.

BACKGROUND OF INVENTION

Very strict regulations apply to mailboxes and particularly rural type mailboxes, both as to their manufacturing specifications and to what can be placed therein. Inside the mailbox itself only postage prepaid mail delivered by the U. S. Postal Service or outgoing mail with postage prepaid waiting for pickup can be placed therein. The laws relating to the postal service includes stiff fines or imprisonment or both for using mailboxes for any other purpose.

Both paid and volunteer workers hand deliver fliers and community announcements on a fairly regular basis. These various items can be attached to the exterior of mailboxes in various ways such as affixing the same with tape, folding the same and wedging them between the box and the flag associated therewith, or simply placing them between the door and the box opening. Many of these items are blown away by the wind or completely ruined by rain thus creating both a litter problem and a loss of information to the residences or businesses for whom the information was intended.

BRIEF DESCRIPTION OF INVENTION

After much research and study into the above mentioned problems the present invention has been developed to provide a receiving means which is mounted on top of a conventional rural type mailbox or similar means for receiving and holding fliers, announcements, a-id the like. The exterior of the present invention acts as an indicia display for the name of the owner, address, various types of decorations or a combination thereof. This combination mailbox indicia display and depository is formed from a flexible material such as hard plastic having a memory so that the two sides can be sprung apart for insertion of the material being deposited and such sides will then snap back together to hold the same in place.

The present invention can be readily mounted on a mailbox through the use of double sided adhesive patches or can be more securely mounted through the use of anchoring means such as self tapping metal screws or bolts.

DISCUSSION OF PRIOR ART

The following references represent the closest prior art of which the inventor is aware and is intended to meet the requirements of 37 CFR 1.8 for Invention Disclosure Agreements.

LIST OF REFERENCES:

U.S. Pat. No. 2,567,487;
Issue Date: Sep. 11, 1951
Inventor: R. L. Kelly.

U.S. Pat. N. 3,243,104;
Issue Date: Mar. 29, 1966;
Inventor: R. M. Fillion.

U.S. Pat. No. 369,278;
Issue Date: Aug. 30, 1887;
Inventor: E. A. Dubey.

U.S. Pat. No. 380,148;
Issue Date: Mar. 27, 1888;
Inventor: S. Thompson.

U.S. Pat. No. 410,905;
Issue Date: Sep. 10, 1889;
Inventor: R. B. Lewis

U.S. Pat. No 3,706,411;
Issue Date: Dec. 19, 1972;
Inventor: Milton Klein

CONCISE EXPLANATION OF REFERENCES

U.S. Pat. No 2,567,487 to Kelly discloses a newspaper receptacle for rural mailboxes which is mounted on the top in spaced relation to said mailbox.

U.S. Pat. No. 3,243,104 to Fillion is considered of interest in that it discloses a receptacle underneath a rural type mailbox with a trapezoid end configuration and with inwardly and downwardly sloping sides.

U.S. Pat. No. 369,278 to Dubey, U.S. Pat. No. 380,148 to Thompson, and U.S. Pat. No. 410,995 to Lewis are all considered of general interest in that they disclose additional separate container means associated with various 19th century mailboxes.

Finally, U.S. Pat. No. 3,706,411 to Klein is considered of interest in that it discloses a mailbox with a tray disposed therebelow for receiving newspapers, magazines, etc.

OBJECTS OF INVENTION

In view of the above it is an object of the present invention to provide a combination mailbox indicia display and depository.

Another object of the present invention is to provide a combination indicia display and depository for mounting on the top of mailboxes wherein the indicia can be readily changed to reflect the owner's moods, the seasons of the year, and the like.

Another object of the present invention is to provide a relatively inexpensive and yet highly efficient depository for fliers, announcements, and other information.

Another object of the present invention is to provide a depository for attachment to mailboxes that clampingly holds information inserted therein.

Another object of the present invention is to provide a changable display on a mailbox depository which is releasably secured through use of hook and loop type fastening means.

Another object of the present invention is to provide a combination indicia display and depository which can be mounted on the top of rural type mailboxes by double sided adhesive patches or strips with provision for mechanical securing means to be used if desired.

Other objects and advantages of the present invention will become apparent and obvious from a study of the following description and the accompanying drawings which are merely illustrative of such invention.

DETAILED DESCRIPTION OF INVENTION

With further reference to the drawings, the combination mailbox indicia display and depository, indicated generally at 10, is so designed as to mount on the top of a rural type mailbox, indicated generally at 11.

Rural type mailboxes of the type shown include a door 12, opposite side walls 13 and a domed top 14. A signal flag 15 is provided on the right side of the mailbox to signal the owner of the mailbox and the postman when outgoing mail is ready for pickup and when the mail has been delivered. Also each of these rural type mailboxes include a back and a bottom (not shown).

Figure 1:
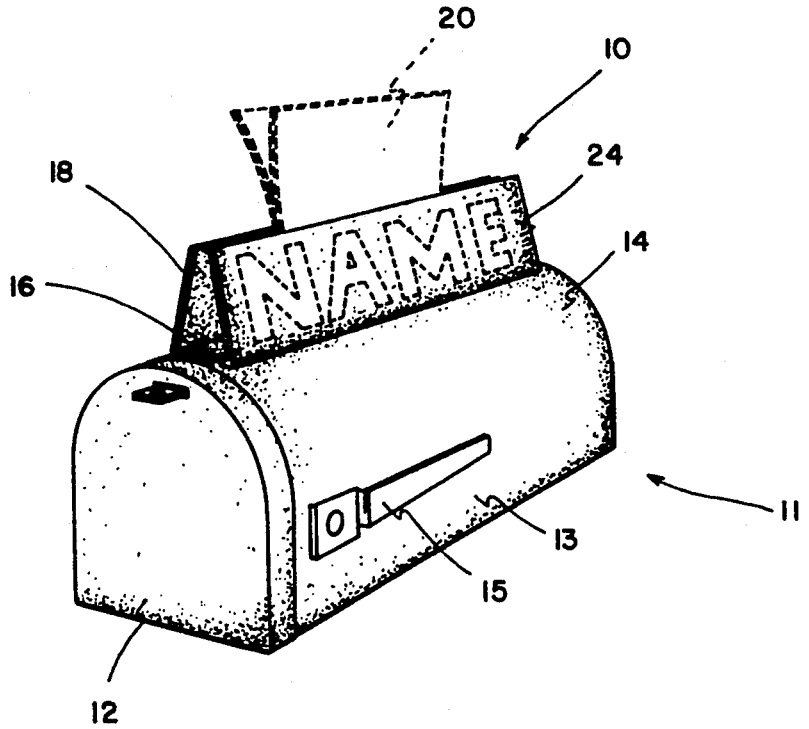
FIG. 1 is a perspective view of the combination mailbox indicia display and depository mounted on a rural type mailbox.
Figure 2:
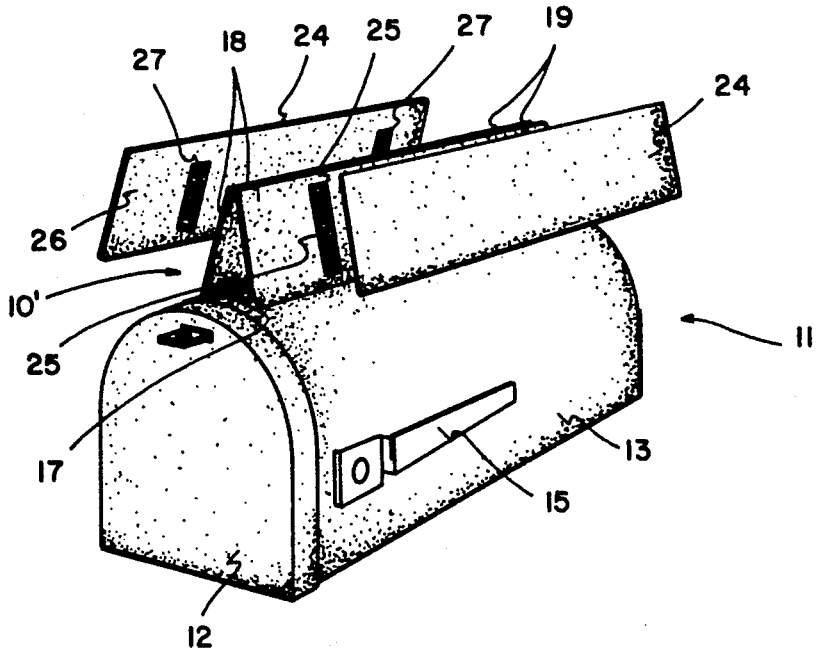
FIG. 2 is a perspective view of the depository mounted on a rural type mailbox with the display indicia being illustrated in an exploded view.
Figure 3:
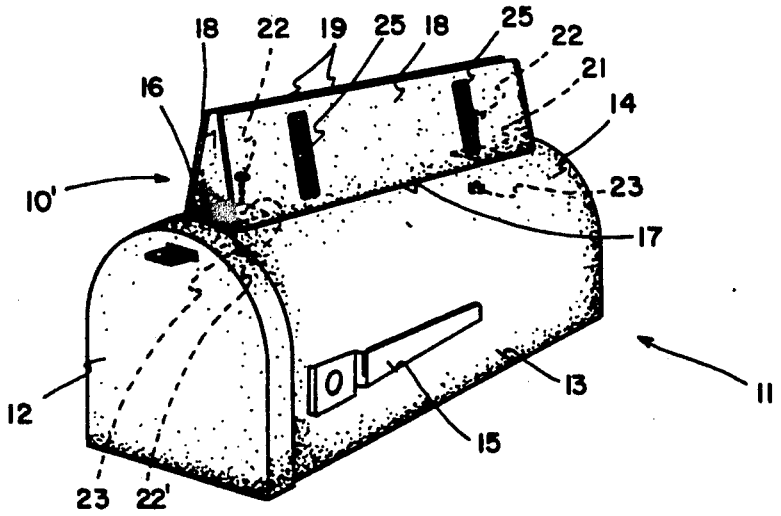
FIG. 3 is a perspective view showing one form of mechanical anchoring means used for attaching the depository to the mailbox.

The depository portion of the present invention includes a slightly concave bottom that is adapted to lie juxtaposed to the convex domed top 14 of mailbox 11 as can clearly be seen in FIGS. 1, 2 and 3.

The sides 17 of the depository extend from the longitudinal edges 17 of bottom 16 upwardly and inwardly to their upper most longitudinal edges 19 where such sides are in normal relaxed position adjacent to each other or can actually be touching.

Figure 4:
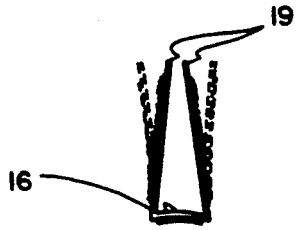
FIG. 4 is an end elevational view of the repository showing how it can be opened for insertion of information.
Figure 5:
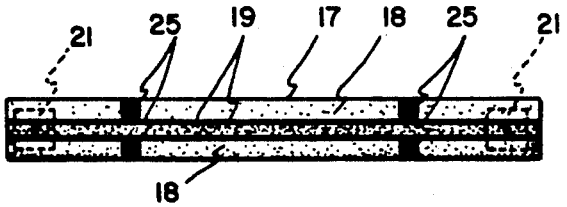
FIG. 5 is a top plan view of the depository.

The depository portion 10' of the present invention is preferably constructed from a single sheet of plastic and bent after heating into the configuration shown particularly clear in FIGS. 2 and 3, or the sane can be continuously extruded and cut to proper length. In either case, the plastic or other material from which the depository is formed has a memory so that its rest or relaxed position is shown in FIGS. 2 and 3 with the upper longitudinal edges disposed adjacent to each other. These upper edges can be spread apart as shown in dotted lines in FIG. 4 for the insertion of fliers, announcement--s or other information. When the spreading pressure is removed the upper edges of the sides will tend to move back to their original positions thus effectively holding the materials placed in the depository as can clearly be seen in FIG. 1 with the deposit-ed material being indicated at 20.

To secure the depository 10' to the mailbox 11, double sided adhesive patches 21 are provided on the underside of bottom 16. When contact is made by double sided adhesive patches 21 of both the bottom 16 and the dome top 14 of box 11, the depository 10' will be mounted on said box 11 as shown in FIGS. 1 and 2. Double sided adhesive patches are widely used for mounting items on, are readily available in retail stores, aid further detailed discussion of the same is not deemed necessary.

Should it be desired to more securely anchor the bottom of the depository to the top of the mailbox, mechanical fasteners such as bolts 22 can be passed through openings 23 provided in bottom 16 and through holes formed in the mailbox top 14 with nuts 24 being tightened to hold the same in place. In this incident the double sided adhesive patches 21 act as seals around the openings to prevent water from entering the same. It is to be understood that other mechanical fastening means such as rivets, metal screws, or the like could be substituted for the bolts and nuts. In each case, however, the double sided adhesive patches would act as seals to prevent rainwater from entering the mailbox 11.

Figure 6:
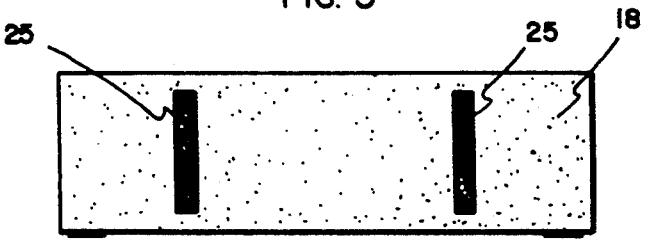
FIG. 6 is a side elevational view thereof.
Figure 7:
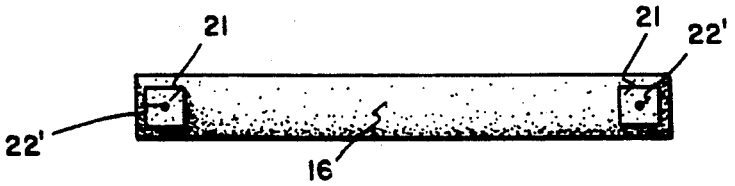
FIG. 7 is a bottom plan view thereof.

The indicia displays 24 are preferably approximately the same length and width as each of the depository sides 18 and are generally flat in configuration. Releasable securing means are provided for mounting the indicia displays on sides 18. These mounting means can be of any suitable type but hook and loop type fastening means have been found to be particularly suited for this purpose. For example, a strip of loop material 25 of the hook and loop fastening means could be secured by adhesive or other suitable means to the exterior of depository side walls 18 as indicated in FIGS. 2 and 6. On the interior surface 26 of each of the display indicium 24 are strips of hook material 27 mounted thereon in engaging alignment with loop material 25. Thus it can be seen that when the interior side 26 of indicia display 24 is pressed against the exterior sides 18 of depository 10', such display will be mounted on such depository as seen clearly in FIG. 1.

Whenever it is desired to change the indicia display, the same can be simply pulled away from the adjacent side 18 in the normal manner of separating hook and loop type fasteners, (which are commonly known and sold under the brand name Velcro). Since the mounting and dismounting of members using Velcro type material is well known to those skilled in the art, further detailed discussion of the same is not deemed necessary.

The use of message flags have become popular in recent years and particularly seasonal flags. Examples of these are flying a pineapple for welcoming guests when having company, having Easter Bunny flags for Easter, fireworks flags for July 4th, pumpkin or ghost flags for Halloween, turkey flags for Thanksgiving and various symbols on flags for Christmas. This idea of seasonal flags can very easily and readily be carrier over into tile indicia display 24 mounted on depository 10'. An example of this would be the owner's name of the mailbox appearing on a number of different displays with seasonal symbols such as Easter eggs before and after the name, ghosts and pumpkins, etc. It is further envisioned that special occasion displays could be provided such as wedding bells to denote that the family was having a wedding, balloons for birthday parties, etc.

From the above it can be seen that the present invention provides a simple, relatively inexpensive arid yet highly efficient depository means for information that is disseminated in the community while at the same tine providing changable displays to fit the moods, special interests, seasons or other desired messages. Since the changable displays are relatively inexpensive, a plurality of the same can be purchased and used at various times.

The present invention can, of course, be carried out in other specific ways than those herein set forth without departing from the spirit and essential characteristics of such invention.

The present embodiments are, therefore, to be considered in all respects as illustrative and not restrictive, and all changes coming within the meaning and equivalency range of the appended claims are intended to be embraced therein.

What is claimed is:

1. An indicia display and depository for use in conjunction with mailbox type containers having domed, convex tops comprising: a depository having a generally concave bottom for lying juxtapose to the convex top of said mailbox; a pair of elongated depository sides extending upwardly and inwardly form said depository bottom and being formed from a deformable material having a memory; and at least one separate indicia display for mounting on at least one of said depository sides whereby said depository can be mounted on said mailbox and said deformable sides can hold material deposited therebetween in place with said sides also being available for receiving desired indicia.

2. The means of clam 1 wherein the bottom of said depository is held in place on top of said box by double sided adhesive material.

3. The means of claim 2 wherein additional mechanical fastening means are used to mount said depository on said box with said adhesive acting as a seal for the same.

4. The means of claim 1 wherein said separate indicia display is removably mounted on said depository.

5. The means of claim 4 wherein hook and loop type material is used to removably mount said indicia display on said depository.

6. The means of claim 4 wherein said removable display contains mood type indicia thereon.

* * * * *